United States Patent [19]

Wepfer

[11] Patent Number: 4,777,911

[45] Date of Patent: Oct. 18, 1988

[54] STAYROD CONFIGURATION FOR FACILITATING STEAM GENERATOR SLUDGE LANCING

[75] Inventor: Robert M. Wepfer, Murrysville, Pa.

[73] Assignee: Westinghouse Electric Corp., Pittsburgh, Pa.

[21] Appl. No.: 99,700

[22] Filed: Sep. 21, 1987

Related U.S. Application Data

[63] Continuation of Ser. No. 875,153, Jun. 17, 1986, abandoned.

[51] Int. Cl.[4] ..... F22B 37/02

[52] U.S. Cl. ..... 122/512; 122/32; 122/379; 122/511

[58] Field of Search ..... 122/379, 381, 382, 390, 122/392, 405, 32, 510, 511, 512; 165/159, 161, 162; 376/405

[56] References Cited

U.S. PATENT DOCUMENTS

| | | | |
|---|---|---|---|
| 2,898,280 | 8/1959 | Schultz | 204/193.2 |
| 3,265,128 | 8/1966 | Legrand | 165/159 |
| 3,557,760 | 1/1971 | Romanos | 122/32 |
| 3,940,168 | 2/1976 | Balon | 285/132 |
| 4,173,997 | 11/1979 | Andrews et al. | 122/32 X |
| 4,276,856 | 7/1981 | Dent et al. | 122/382 |
| 4,303,043 | 12/1981 | Redding | 122/382 |
| 4,357,908 | 11/1982 | Yazidjian | 122/32 |

*Primary Examiner*—Steven E. Warner

[57] ABSTRACT

A stayrod configuration for permitting complete sludge lancing of the tubesheet, including a plurality of first stayrods, each having the same diameter as the steam generator tubing and being threaded into the tubesheet at spaced positions which match the tube pattern. This plurality of first stayrods is attached to a connector, which is threaded to provide a receptacle for a second, full-length stayrod within a shortened spacer.

8 Claims, 5 Drawing Sheets

STAYROD CONFIGURATION FOR FACILITATING STEAM GENERATOR SLUDGE LANCING

This application is a continuation of application Ser. No. 06/875,153 filed June 17, 1986 , now abandoned.

BACKGROUND OF THE INVENTION

This invention relates to steam generators and, more particularly, to an apparatus for facilitating removal of sludge deposits from the tubesheets of steam generators.

A typical nuclear steam generator generally comprises: a vertically oriented shell; a plurality of U-shaped tubes disposed in the shell so as to form a tube bundle; a tubesheet for supporting the tubes at the ends opposite the U-like curvature; a plurality of tube support plates spaced along the tube bundle parallel and above the tubesheet; a plurality of cylindrical spacers extending perpendicular between adjacent tube support plates; and a plurality of stayrods, each having a diameter larger than each tube, extending through the tube support plates and spacers and being threaded into the tubesheet to limit deflection of the tube support plates during break loadings of the steamline and feedline of the steam generator.

The steam generator also comprises a wrapper barrel disposed between the tube bundle and the shell to form an annular chamber adjacent the shell, and a feedwater header or ring disposed above the U-like curvature end of the tube bundle. Primary fluid having been heated by circulation through the reactor core enters the steam generator and moves through the U-tube bundle. While feedwater is circulating in heat transfer relationship around the tube bundle, heat is transferred from the primary fluid circulating in the tubes to the feedwater plus recirculating water, thus causing a portion of the recirculating water to be converted to steam. The steam then rises and is circulated through typical electrical generating equipment, thereby generating electricity in a manner well known in the art.

Such nuclear steam generators must be serviced during shutdown periods to remove sludge left from the feedwater which predictably accumulates at the tubesheet. Servicing involves opening handhole covers near the tubesheet region, and inserting a sludge lancing tool therein, such as described in U.S. Pat. No. 4,276,856, entitled Steam Generator Sludge Lancing Method," issued to Dent et al. and assigned to Westinghouse Electric Corp. The sludge lancing tool shoots a jet of high pressure water into the respective lanes formed between the tubes, thus loosening the sludge from the tubesheet surface, and entraining the sludge in a flow of water which is then drawn off of the tubesheet. The stayrods, however, have been known to impede lancing of some area of the tubesheet since they are larger than the tubes and effectively block some of the sludge lancing lanes.

In light of the above problem, more efficient sludge lancing of the tubesheet is required.

SUMMARY OF THE INVENTION

Accordingly, it is an object of the present invention to provide a stayrod configuration for facilitating steam generator sludge lancing which is capable of adequately reinforcing the tube support plates during steamline and feedline break loadings, but which also does not block sludge lancing lanes.

It is another object of the present invention to provide a stayrod configuration for facilitating steam generator sludge lancing which requires minimal modification of the existing tubesheet and stayrods, is relatively simple in construction and does not significantly increase costs related to steam generator construction or maintenance.

To achieve the foregoing and other objects of the present invention and, in accordance with the purposes of the invention, there is provided a stayrod configuration which permits complete sludge lancing of the tubesheet, including a plurality of first stayrods, each having the same diameter as the tubing and being threaded into the tubesheet at spaced positions which match the tube pattern. This plurality of first stayrods is attached to a connector, which is threaded to provide a receptacle for a second, full-length stayrod within a shortened spacer.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
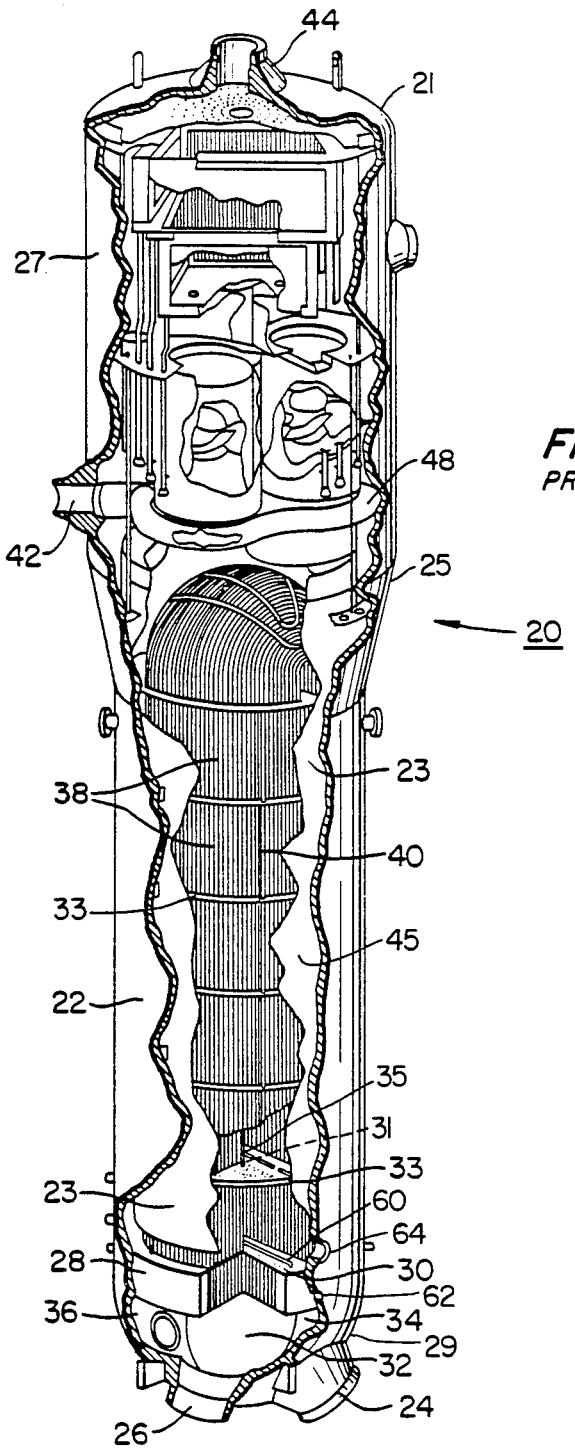
FIG. 1. PRIOR ART
FIG. 1 is a partial, cross-sectional view in elevation of a typical steam generator.

A typical nuclear steam generator of the type generally referred to herein as reference numeral 20 is shown in FIG. 1 and is described in greater detail in co-assigned U.S. Pat. No. 4,303,043, issued to Malick. Such a nuclear steam generator 20 comprises a lower shell 22 connected to an upper shell 27 by a frustro-conical transition shell 25. A dished head 21 having a steam nozzle 44 disposed thereon terminates upper shell 27, while a substantially spherical head 29 having an inlet nozzle 24 and an outlet nozzle 26 disposed thereon terminates lower shell 22.

A dividing plate 32 centrally disposed in spherical head 29 divides spherical head 29 into an inlet plenum 34 and an outlet plenum 36. The inlet plenum 34 is in fluid communication with inlet nozzle 24, while outlet plenum 36 is in fluid communication with outlet nozzle 26.

A tubesheet 28 having tube holes 30 formed therein is attached to lower shell 22 and spherical head 29 so as to isolate the portion of the steam generator 20 above tubesheet 28 from the portion below tubesheet 28 in a fluid-tight manner.

Tubes 38 which are heat transfer tubes shaped with a U-like curvature are disposed in tube holes 30. Tubes 38 which may number about 7,000 form a tube bundle 40. Spaced parallel along the tube bundle 40 are tube support plates 33 which are reinforced perpendicularly with stayrods 31 enclosed in corresponding tubular spacers 35. Each tube 38 extends from tubesheet 28 where one end thereof is in fluid communication with inlet plenum 24, up into transition shell 25 where each tube 38 is formed in the U-like configuration, and back down to tubesheet 28 where the other end of each tube 38 is in fluid communicaton with outlet plenum 36.

In operation, the reactor coolant having been heated from circulation through the reactor core enters steam generator 20 through inlet nozzle 24 and flows into inlet plenum 34. From inlet plenum 34, the reactor coolant flows through tubes 38 in tubesheet 28, up through the U-shaped curvature of the tubes 38, and down through tubes 38 into outlet plenum 36. From outlet plenum 36, the reactor coolant is circulated through the remainder of the reactor coolant system in a manner well known in the art.

Again referring to FIG. 1, tube bundle 40 is encircled by a wrapper barrel 23 which extends from near the tubesheet 28 into the region of the transition shell 25. Wrapper barrel 23, together with lower shell 22 form an annular chamber 45 therebetween. A secondary fluid or feedwater inlet nozzle 42 is disposed on upper shell 27 above tube bundle 40. A feedwater header 48 comprising three loops forming a generally cloverleaf-shaped ring is attached to feedwater inlet nozzle 42.

During operation, feedwater enters steam generator 20 through the feedwater inlet nozzle 42 and the feedwater header 48. The feedwater flows down annular chamber 45 until the feedwater contacts tubesheet 28. Once reaching the bottom of annular chamber 45 near tubesheet 28, the feedwater is directed inwardly around tubes 38 of tube bundle 40 where the feedwater passes in heat transfer relationship with tubes 38. The hot reactor coolant in tubes 38 transfers heat through tubes 38 to the feedwater circulating therearound, which heats the feedwater. The heated feedwater then rises by natural circulation up around the tube bundle 40. In its travels around the tube bundle 40, the feedwater continues to be heated until steam is produced in a manner well known in the art.

Figure 2:
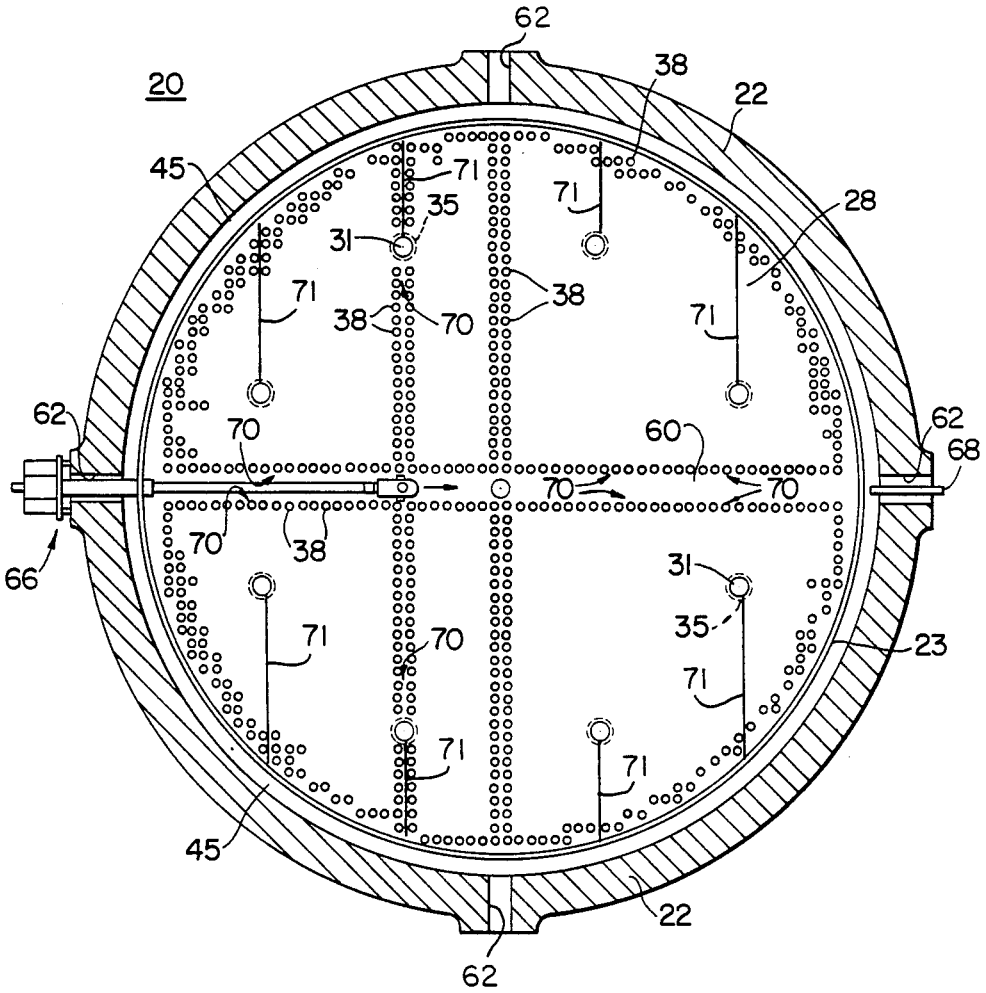
FIG. 2. (PRIOR ART)
FIG. 2 is a top plan view of a tubesheet, illustrating particularly introduction of a conventional sludge lancing tool.

Referring in greater detail to the lower portion of FIG. 1 and FIG. 2, due to the curvature of tubes 38, a straight line section of tubesheet 28 is without tubes therein. This section is referred to as the tube lane 60. In conjunction with tube lane 60, two inspection ports 62 which may be 2 inches in diameter are provided diametrically opposite each other and in colinear alignment with tube lane 60. Two additional inspection ports 62 may be located on shell 22 at 90° to the tube lane 60. Inspection ports 62 allow limited access to the tubesheet 28 area. In addition, 6 inch diameter hand holes 64 may also be provided.

Experience has shown that during steam generator operation as described above, sludge may form on the tubesheet 28 around tubes 38. The sludge, which usually comprises iron oxides, copper compounds, and other metals, is formed from these materials settling out of the feedwater onto tubesheet 28. The sludge ultimately produces defects in the tubes 38 which allow radioactive particles in the reactor coolant contained in the tubes 38 to leak out into the feedwater and steam of the steam generator 20, a highly undesirable result.

Referring again to FIG. 2, when the reactor is not operating, such as during refueling, the steam generator 20 may be deactivated and drained of the recirculating water. The inspection ports 62 are then opened to provide access to the interior of the steam generator 20. A sludge lancing tool or fluid lance 66, such as described in U.S. Pat. No. 4,276,856 introduced above, is then placed through one of the inspection ports 62, while a suction header 68 is placed in the inspection port 62 opposite the inspection port 62 in which the fluid lance 66 has been placed. The fluid lance 66 is then moved along tube lane 60, emitting fluid through nozzles into sludge lanes 70 between the tubes 38 in an effort to dislodge the sludge which has accumulated during operation of the steam generator 20.

Figure 3:
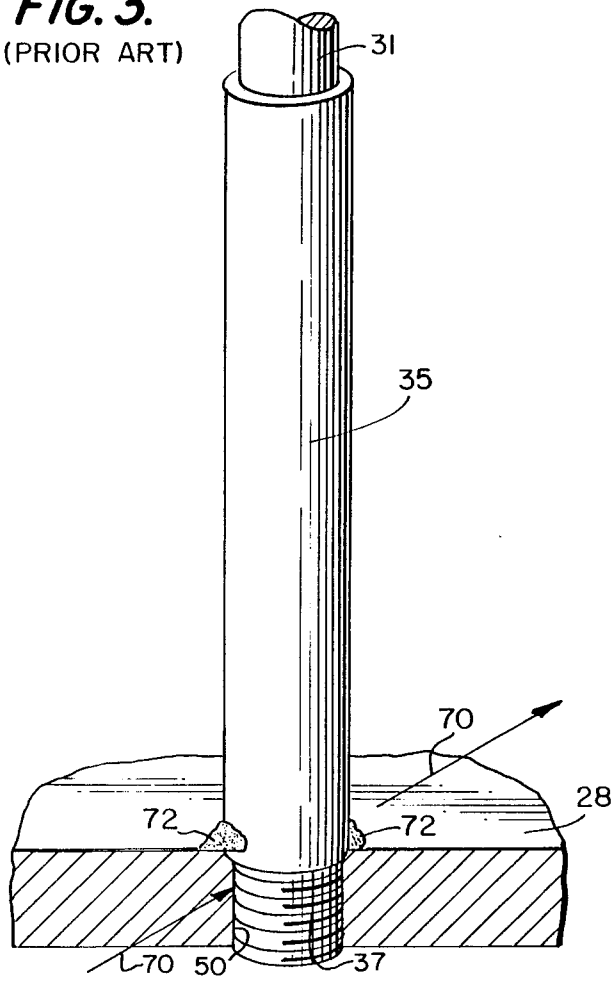
FIG. 3. (PRIOR ART)
FIG. 3 is a side elevational view of a conventional stayrod threaded into the tubesheet with a typical spacer pipe.

As can be seen, however, several sludge lanes 70 are effectively blocked by the stayrods 31 threaded into the tubesheet 28. That is, the conventional stayrod 31 shown in FIG. 3 includes a threaded end 37 which is screw inserted into an opening 50 formed in the tubesheet 28. This stayrod 31 has a larger diameter than the tubes 38 and takes up, along with a spacer 35, the same area as four tubes 38, which effectively causes blockage of the sludge lane 70. This blockage leads to a build-up of sludge 72 at the stayrod 31/tubesheet 28 intersection and in the portions 71 of sludge lanes 70 behind stayrods 31.

The present invention overcomes the sludge lancing problems characteristic of the conventional, single, relatively large diameter stayrod 31 described above. The preferred embodiment of the stayrod configuration 90 of the present invention will now be described.

Figure 4:
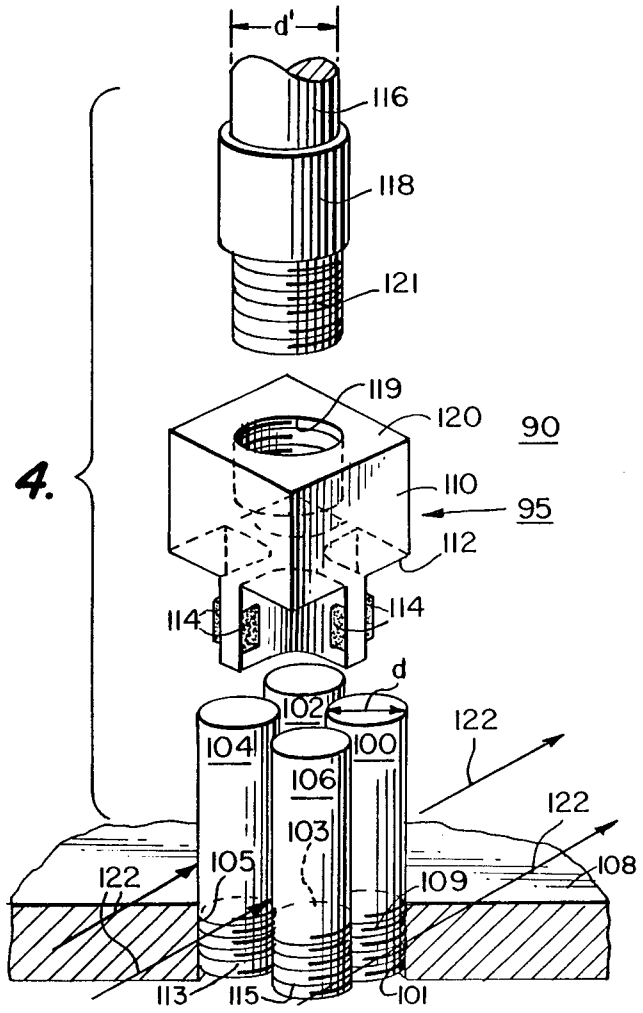
FIG. 4 is an exploded view of one embodiment of the stayrod configuration according to the present invention.

Referring to FIG. 4, a plurality of solid first stayrods 100, 102, 104 and 106 is provided, each including a threaded end 109, 111 (not shown), 113 and 115, respectively, which is screw inserted into a corresponding opening 101, 103, 105 and 107 (not shown) formed in a tubesheet 108. The stayrods 100, 102, 104 and 106 are oriented in spaced relation in the tubesheet 108 at positions which match the tube 38 pattern, i.e., the plurality of openings formed in the tubesheet to receive the tube bundle 40.

The plurality of first stayrods is preferably four, each being $\frac{3}{4}$ inch in diameter, i.e., approximately equal to the diameter of a single tube 38. However, the present invention contemplates other numbers of first stayrods such as in a triangular pitch tube array. The material of the plurality of first stayrods 100, 102, 104 and 106 is preferably the same as that of a conventional stayrod 31, i.e., carbon steel.

After the plurality of first stayrods 100, 102, 104 and 106 has been completely threaded into the corresponding openings 101, 103, 105 and 107, respectively, formed in the tubesheet 108, a connecting means 95, such as a connector 110, with a cruciform cross section at a first end 112 thereof, is inserted between the vertically positioned stayrods 100, 102, 104 and 106.

The connector 110 is connected to each of the first stayrods via, e.g., welds 114, in the gap created by the diverging sides of the cruciform and each stayrod 100, 102, 104 and 106. The welds 114 prevent the rotation of the stayrods 100, 102, 104 and 106 and, therefore, prevent the potential for loose parts in the steam generator 20. The welds 114 also permit the full strength of the first plurality of stayrods 100, 102, 104 and 106 to be transmitted to the connector 110.

Finally, a second stayrod 116 is employed which is received by a spacer 118 that is shorter than the conventional spacer 35. The second stayrod 116 includes a threaded end 121 which is screw inserted into a threaded opening 119 formed at the top 120 of the connector 110. The diameter d' of the second stayrod 116 is preferably greater than the diameter d of each of the plurality of first stayrods 100, 102, 104 and 106.

The cruciform cross-section of the connector 110 is preferably larger than that of the second stayrod 116, so, as long as the yield strength of the connector 110 is comparable to that of the second stayrod 116, the overall strength characteristics of a conventional stayrod 31 will be maintained.

As can be seen, the preferred embodiment of the present invention provides for uninterrupted sludge lanes 122. As a result, sludge does not accumulate undesirably in the sludge lanes 122.

Figure 5:
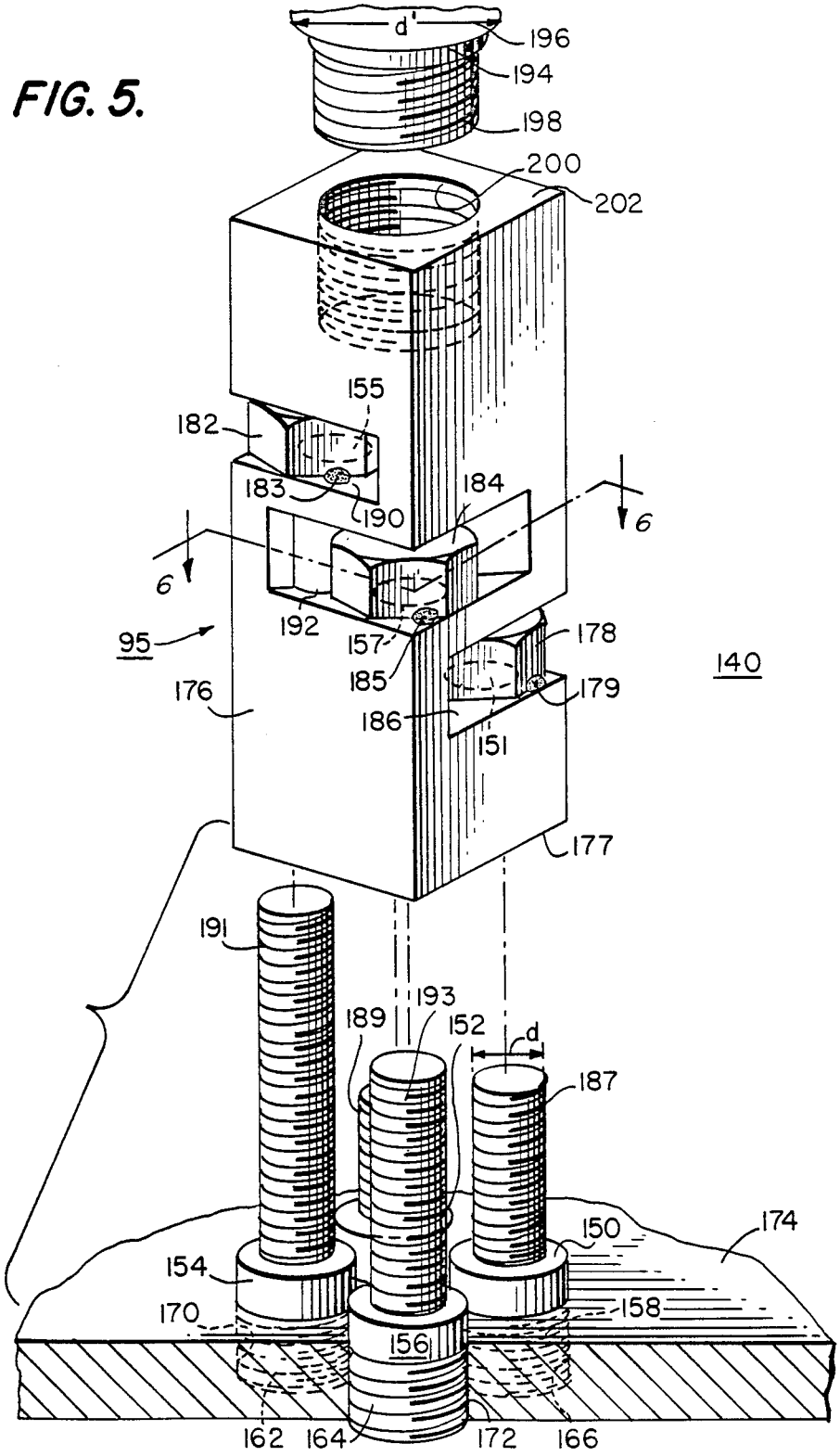
FIG. 5 is an exploded view of an alternate embodiment of the stayrod configuration according to the present invention.
Figure 6:
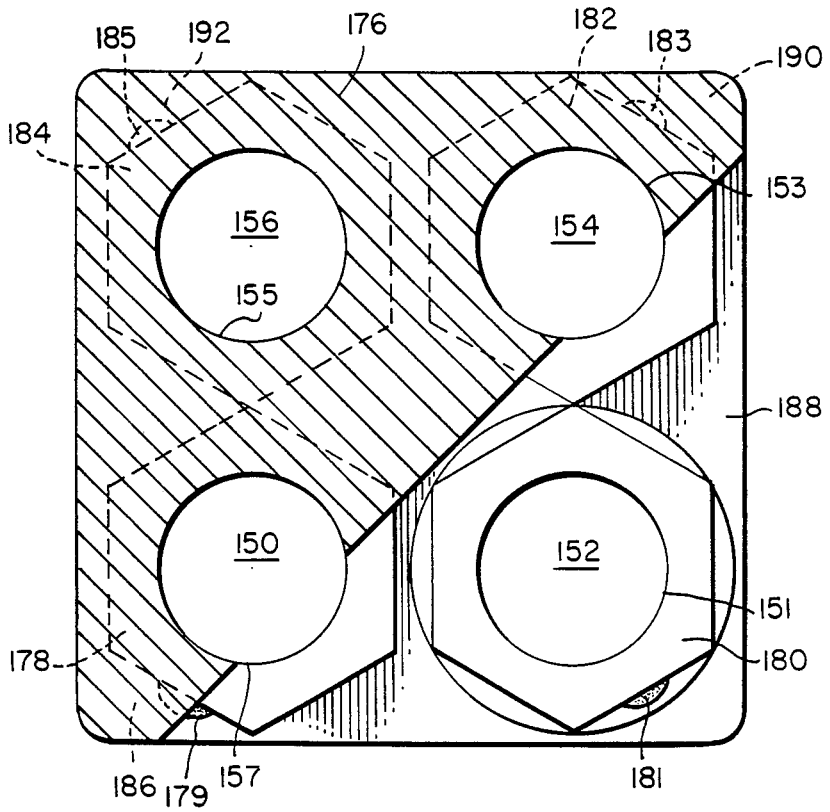
FIG. 6 is a cross-sectional view of the alternate embodiment of the stayrod configuration shown in FIG. 5 taken along line 6—6.

An alternate embodiment of the present invention is the stayrod configuration 140 shown in FIGS. 5 and 6, including a plurality of first stayrods 150, 152, 154 and 156, each of which includes a threaded end 158, 160 (not shown), 162 and 164, respectively. Each stayrod 150, 152, 154 and 156 is screw inserted into a corresponding threaded opening 166, 168 (not shown), 170 and 172 formed in a tubesheet 174. The stayrods 150, 152, 154 and 156 are again oriented in spaced relation in the tubesheet 174 at positions matching the tube 38 pattern.

After the plurality of first stayrods 150, 152, 154, and 156 have been completely threaded into the corresponding openings 166, 168, 170 and 172, respectively, formed in the tubesheet 174, the connecting means 95, such as a connector 176 of substantially parallelogram shape, is lowered onto the vertically positioned stayrods 150, 152, 154 and 156 via cylindrical openings 151, 153, 155 and 157, respectively, formed in the connector 176. The connector 176 is connected to the plurality of first stayrods via, e.g., rotatable nuts 178, 180, 182, and 184 received by corresponding receptacles 186, 188, 190 and 192 formed at the respective corners of the cnnector 176. The rotatable nuts 178, 180, 182 and 184 receive the opposite threaded ends 187, 189, 191, 193 of the plurality of first stayrods 150, 152, 154, 156, respectively.

The triangular shape of each receptacle 186, 188, 190 and 192 permits the rotation of the nuts 178, 180, 182 and 184. Tack welds 179, 181, 183 and 185 prevent rotation of nuts 178, 180, 182 and 184 with respect to block 177. The nuts 178, 180, 182 and 184 restrain first stayrods 150, 152, 154 and 156, thereby preventing the potential for loose parts in the steam generator 20. These nuts also permit the full strength of the plurality of first stayrods 150, 152, 154 and 156 to be transmitted to the connector 176.

Finally, a second stayrod 194 is employed which is received by a spacer 196 that is shorter than the conventional spacer 35. The second stayrod 194 includes a threaded end 198 which is screw inserted into a threaded opening 200 formed at the top 202 of the connector 176. The diameter d' of the second stayrod 194 is preferably greater than the diameter d of each of the plurality of first stayrods 150, 152, 154 and 156.

The foregoing is considered illustrative only of the principles of the invention. Further, since numerous modifications and changes will readily occur to those skilled in the art, it is not desired to limit the invention to the exact construction and operation shown and described. For example, the present invention can also be easily adapted to a triangular pitch tube array. Accordingly, all suitable modifications and equivalents may be resorted to, falling within the scope of the invention and the appended claims and their equivalents.

We claim:

1. A stayrod configuration for facilitating sludge lancing in a steam generator, comprising:

(a) a tubesheet;

(b) four solid first stayrods connected in spaced relation to the tubesheet;

(c) connecting means connected to the first stayrods;

(d) a second stayrod connected to the connecting means, said second stayrod having a diameter greater than each of the first stayrods; and (e) wherein one end of each of the first stayrods is threaded and is connected to a corresponding threaded opening formed in the tubesheet, and one end of the second stayrod is threaded and is connected to the connecting means via a corresponding threaded opening formed in the connecting means.

2. A stayrod configuration for facilitating sludge lancing in a steam generator, comprising:

(a) a tubesheet;

(b) four first stayrods connected in spaced relation to the tubesheet;

(c) connecting means connected to the first stayrods;

(d) a second stayrod connected to the connecting means, said second stayrod having a diameter greater than each of the first stayrods;

(e) wherein one end of each of the first stayrods is threaded and is connected to a corresponding threaded opening formed in the tubesheet, and one end of the second stayrod is threaded and is connected to the connecting means via a corresponding threaded opening formed in the connecting means; and (f) wherein the connecting means is a connector having a first end formed in a cruciform shape.

3. The configuration as recited in claim 2, wherein the connecting means is connected to the plurality of first stayrods via welds.

4. The configuration as recited in claim 2, wherein the connecting means is a connector with substantially parallelogram shape.

5. The configuration as recited in claim 4, wherein the connector is connected to the plurality of first stayrods via cylindrical openings and rotatable nuts.

6. A stayrod configuration for facilitating sludge lancing in a steam generator, comprising:

(a) a tubesheet having a plurality of threaded openings formed therein;

(b) four solid first stayrods, each having a threaded end and being screw inserted into a respective one of the plurality of threaded openings formed in the tubesheet;

(c) a connector having a first end formed in a cruciform shape connected to the four solid first stayrods; and (d) a second stayrod which is threaded and is connected to the connector via a corresponding threaded opening formed in the connector.

7. The configuration as recited in claim 6, wherein the connector is connected to each of the four solid first stayrods via welds.

8. The configuration as recited in claim 6, wherein the connector is connected to each of the four solid first stayrods via cylindrical openings and rotatable nuts.

* * * * *